United States Patent [19]

Remontet

[11] 4,420,926

[45] Dec. 20, 1983

[54] TWISTING SPINDLE DRIVEN BY AN INDIVIDUAL ELECTRIC MOTOR

[75] Inventor: Jean Remontet, Loire, France

[73] Assignee: ASA S.A., France

[21] Appl. No.: 390,703

[22] Filed: Jun. 21, 1982

[30] Foreign Application Priority Data

Jun. 29, 1981 [FR] France ..... 81 12918

[51] Int. Cl.[3] ..... D01H 1/244; D01H 7/08

[52] U.S. Cl. ..... 57/100; 57/129

[58] Field of Search ..... 57/100, 129, 133, 134, 57/130, 135

[56] References Cited

U.S. PATENT DOCUMENTS 2,274,147 2/1942 Kelley ..... 308/169
2,571,267 10/1951 Ljunggren ..... 57/100
4,361,004 11/1982 Hartmannsgruber ..... 57/100

FOREIGN PATENT DOCUMENTS 638798 11/1936 Fed. Rep. of Germany .
650239 9/1928 France .
2095830 1/1972 France .

*Primary Examiner*—John Petrakes
*Attorney, Agent, or Firm*—Parkhurst & Oliff

[57] ABSTRACT

A twisting spindle driven by an individual electric motor wherein fastening of the body of the motor as well as maintaining and guiding of the barrel of the spindle are effected via a rigid sleeve surrounding the barrel, the sleeve passing through the frame and serving as a cage for anti-friction bearings which permit rotation of the spindle, and having at its ends two collars, one fastened elastically to the frame and the other rigidly connected to the body or stator of the motor.

4 Claims, 3 Drawing Figures

TWISTING SPINDLE DRIVEN BY AN INDIVIDUAL ELECTRIC MOTOR

The present invention relates to an improvement in the spindle used in the textile industry, in particular for the twisting of threads.

Twisting spindles have been known for a very long time and consist essentially of an arbor (or spindle barrel) mounted for free rotation on the frame of the machine via a suitable bearing.

The tube around which the thread is wound is force-fitted onto the barrel of the spindle. The barrel of the spindle, and therefore the bobbin of thread, can be driven in rotation in various manners.

The most common method consists of driving the spindles of the machine by means of an endless belt brought into tangential contact with the base of the spindle barrel.

In order to increase the speeds of production and to obtain packages of high weight, it has been proposed for a long time, in particular in U.S. Pat. No. 2,274,147, to drive the spindles individually by means of an electric motor.

The present invention concerns an improvement in such spindles which are driven by an individual motor.

One of the main problems which arises with such individually driven spindles is the increase in the height of the center of gravity of the bobbin and the barrel spindle, in view of the fact that the motor is arranged above the lower bearing of the system supporting the spindle.

This increase in the height of the center of gravity therefore increases the risk of vibration and limits the speeds of use as well as the size of the packages of threads.

U.S. Pat. No. 2,274,147 describes a solution which makes it possible, to a certain extent, to solve the vibration problem. This solution consists, on the one hand, of mounting the barrel of the spindle in an oil bearing, which also makes it possible to assure lubrication and, on the other hand, of arranging a layer of vibration-absorbing material, for instance a layer of cork or equivalent material, between the frame of the machine and the housing of the drive motor.

Such an embodiment, however, is of rather complicated construction and, in particular, does not solve the problem of lowering the center of gravity of the spindle/thread-package assembly towards the fixed frame of the machine, which therefore limits the speeds of operation and the weight of the packages.

French Patent No. 2 095 830 describes a solution which makes it possible to decrease the height of the center of gravity of the bobbin and the motor. This solution consists of using a motor of small dimensions, particularly of small height, this motor being a two-pole electric motor, in particular an asynchronous motor, whose stator is provided with a flat ring winding. Although by using such a motor there is logically obtained a lowering of the center of gravity, the center of gravity nevertheless still is located definitely above the support frame, in view of the fact that this motor is always arranged above the bearing which supports the spindle and therefore above the support frame.

Now there has been found, and this forms the object of the present invention, a new type of spindle driven by an individual electric motor which overcomes the drawbacks of the previous spindles due to the fact that the vibrations are effectively dampened and the center of gravity of the spindle and of the package which it supports is brought back practically to the height of the stationary frame of the machine supporting said spindle.

In general, the invention therefore concerns a twisting spindle which is driven by an individual electric motor, of the type comprising:

a spindle stock which is mounted freely for rotation on a support frame, a motor whose rotor is rigidly connected with said barrel, means which make it possible firmly to connect the stator of the motor with the frame, and characterized by the fact that fastening of the body (stator) of the motor and holding and guiding the barrel of the spindle are effected by a sleeve which surrounds the barrel of the spindle, said sleeve:

passing through the frame and serving as a cage for the anti-friction bearings which permit rotation of the spindle, having at its ends two collars, an upper collar elastically fastened to the frame and a lower collar firmly secured to the housing of the motor.

Preferably, in accordance with the invention:

the motor is a conventional asynchronous two-pole motor, the anti-friction bearings which guide and support the barrel of the spindle are arranged on opposite sides of the stationary frame of the machine, elastic connection between the rigid flange and the frame is obtained by means of studs, for instance elastomeric studs, interposed between the upper collar and the support frame, or on opposite sides of the support frame.

The invention and the advantage which it provides will, however, be better understood from the embodiment which is described below by way of illustration and not of limitation and is illustrated in the accompanying drawings in which.

Figure 1:
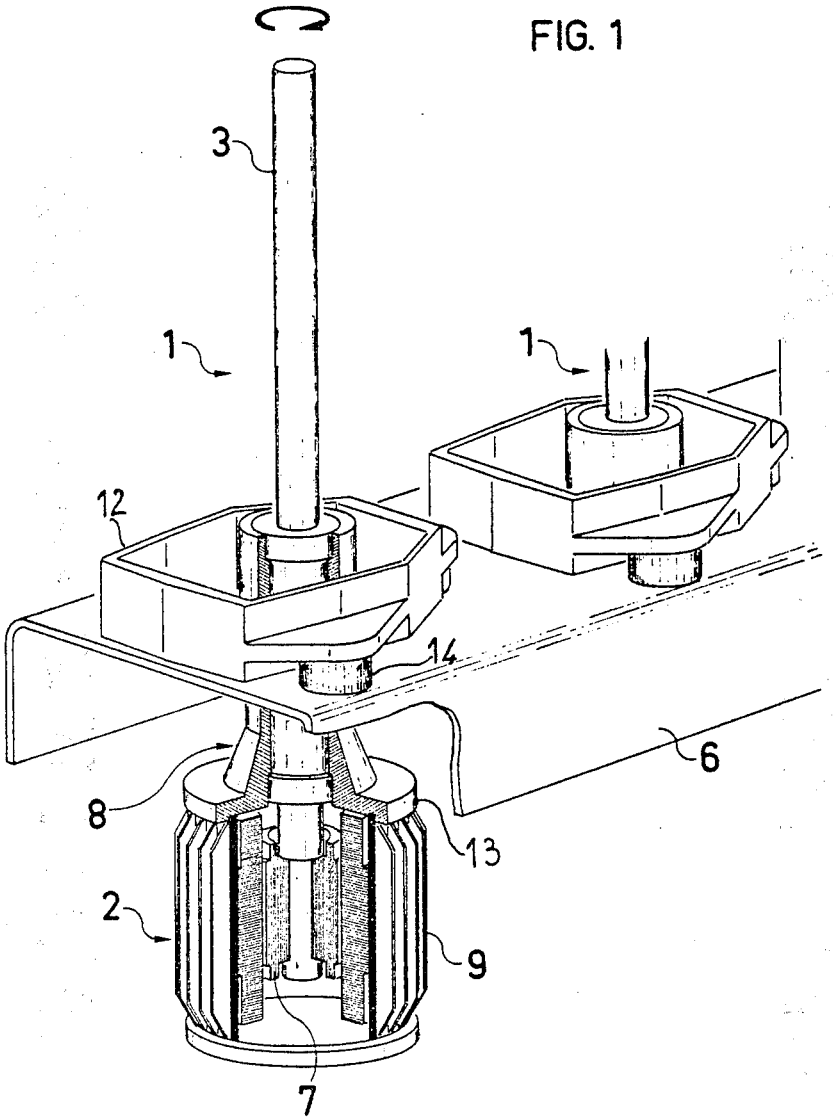
FIG. 1 is a diagrammatic view in perspective showing a spindle in accordance with the invention in cross-section.

Referring to the accompanying drawings, FIG. 1 shows a textile machine having two twisting spindles, designated by the general reference number 1, in accordance with the invention.

Each of these twisting spindles 1 is of the type driven by an individual electric motor, designated by the general reference number 2, preferably a two-pole asynchronous motor fed in conventional manner (not shown), for instance by an alternator.

This spindle comprises essentially a barrel 3 intended to support the package of thread 4 (not shown in FIG. 1).

The barrel 3 is mounted freely for rotation on a support frame 6, formed in the present case of a horizontal profiled member of inverted U-shape, attached to the body of the machine.

This spindle 1 is driven, as previously stated, by an individual motor 2 whose rotor 7 is fastened directly to the barrel 3 by means designated by the general reference number 8 which make it possible to fasten securely the body 9, and therefore the stator, of the motor 2.

In accordance with the invention, the fastening of the body 9 of the motor 2 as well as the holding and guiding of the barrel 3 of the spindle are effected by securing means 8, and this via a rigid sleeve 5 which surrounds the barrel 3, this sleeve 5 passing through the frame 6 and serving as a cage for the anti-friction bearings 10, 11 which permit rotation of the spindle 1. The sleeve 5 is provided at its ends with two collars 12, 13, the upper one 12 being elastically fastened to the frame 6 while the lower one 13 is rigidly connected to the body 9 of the motor 2.

Figure 2:
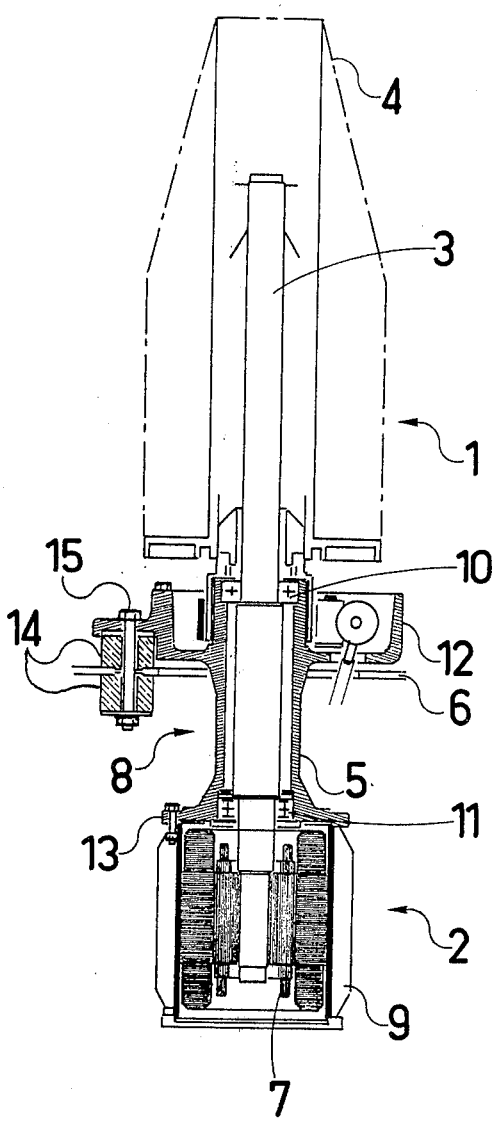
FIG. 2 is a detail view in cross-section of such a spindle.

The means permitting the elastic attachment of the sleeve 5 advantageously consist of studs 14 having a base of elastomer, these studs 14 in suitable number being arranged, in the embodiment illustrated in FIG. 1, between the upper collar 12 and the upper part of the frame 6 by means of fastening bolts, while, in the embodiment shown in FIG. 2, these means also comprise studs 14, but they are arranged on opposite sides of the upper part of the support frame 6, these studs being held by means of bolts 15.

By such an embodiment in accordance with which the motor 2 is arranged at the end of the barrel 3, the connection of the assembly being effected elastically and the guiding of the barrel 3 being effected by bearings (anti-friction bearings 10, 11) arranged on opposite sides of the upper part of the frame 6, it is possible to have a distribution of the weights on opposite sides of the attachment points and accordingly to lower the center of gravity of the spindle/motor assembly substantially to the height of the frame 6.

Such an embodiment makes it possible almost completely to limit vibrations and therefore to use a motor having an air gap which is as small as possible and which can therefore be of optimum efficiency.

Figure 3:
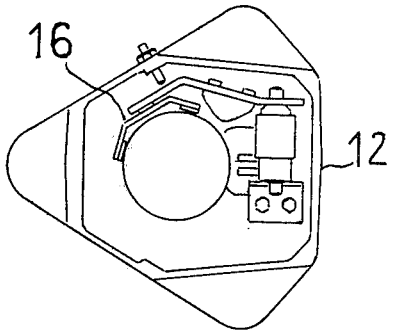
FIG. 3 shows, in top view, an individual braking system associated with such a spindle.

In addition to the fact that such a design makes it possible to eliminate vibrations due to the lowering of the center of gravity and the elastic mounting of the assembly on the support frame, it is also possible to obtain the individual stopping of the spindles. This can be obtained, as shown diagrammatically in FIG. 3, by associating with each spindle an incorporated individual braking system, which can be formed, for instance, of a jaw 16 acting on the barrel of the spindle. This jaw 16 can be operated pneumatically or electrically by any known means, which it is unnecessary to describe in detail.

Finally, this spindle also has the advantage of being very silent and, as a result of its design, it can be easily removed, which favors maintenance.

Of course, the present invention is not limited to the embodiment described above, but also covers all variants developed along the same line.

Thus if individual studs distributed circumferentially around the barrel of the spindle are used preferably as elastic dampening means it could be contemplated to use mono-block studs in the form of a ring. It is obvious that such studs can be replaced by any equivalent means, for instance systems with elastic blades.

What is claimed is:

1. A twisting spindle driven by an individual electric motor, the spindle comprising:

a spindle barrel mounted on a support frame by means permitting free rotation of the barrel;

a motor having a rotor which is rigidly connected to the spindle barrel, with the rotor or stator of the motor rigidly connected to the support frame by a sleeve extending therethrough and surrounding the barrel of the spindle;

the sleeve having an upper collar elastically fastened to the support frame and a lower collar rigidly connected to the body or stator of the motor, with anti-friction bearings contained within the sleeve.

2. The spindle of claim 1, wherein the elastic attachment of the upper collar of the sleeve to the support frame is accomplished by the placement of elastic dampening studs between an upper portion of the support frame and a lower portion of the upper collar and additional elastic dampening studs placed in contact with a lower portion of the support frame with a bolt extending through the elastic attachment assembly.

3. The twisting spindle of claim 1, wherein the motor is an asynchronous two-pole electric motor.

4. The twisting spindle of claim 1 additionally comprising an individual braking system surrounding the twisting spindle having a jaw-type brake thereabout.

* * * * *